US008475175B2

(12) United States Patent
Gerard

(10) Patent No.: US 8,475,175 B2
(45) **Date of Patent: *Jul. 2, 2013**

(54) REORIENTABLE ELECTRICAL RECEPTACLE

(75) Inventor: Kimberly R. Gerard, Murray, UT (US)

(73) Assignee: 360 Electrical, LLC, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/541,383

(22) Filed: Jul. 3, 2012

(65) Prior Publication Data

US 2012/0270416 A1 Oct. 25, 2012

Related U.S. Application Data

(63) Continuation of application No. 13/219,865, filed on Aug. 29, 2011, now Pat. No. 8,210,853, which is a continuation of application No. 12/835,722, filed on Jul. 13, 2010, now Pat. No. 8,007,283, which is a continuation of application No. 11/778,948, filed on Jul. 17, 2007, now Pat. No. 7,753,682.

(51) Int. Cl.
*H01R 39/00* (2006.01)

(52) U.S. Cl.
USPC ..... 439/13

(58) Field of Classification Search
USPC ..... 439/13, 446, 11, 164, 21, 651, 534, 439/6, 8, 17, 22, 18
See application file for complete search history.

(56) References Cited

U.S. PATENT DOCUMENTS

| | | | | |
|---|---|---|---|---|
| 3,395,243 | A * | 7/1968 | Kelly | 174/504 |
| 6,544,069 | B1 * | 4/2003 | Enriquez et al. | 439/534 |
| 7,249,976 | B1 * | 7/2007 | Watson | 439/651 |
| 7,753,682 | B2 * | 7/2010 | Gerard | 439/13 |
| 8,007,283 | B2 * | 8/2011 | Gerard | 439/13 |
| 8,210,853 | B2 * | 7/2012 | Gerard | 439/13 |

* cited by examiner

*Primary Examiner* — Edwin A. Leon
(74) *Attorney, Agent, or Firm* — Denko Coburn & Lauff LLP

(57) ABSTRACT

There is provided systems and methods for a reorientable electrical outlet. In one embodiment, a system includes a housing configured to be coupled to an electrical power source, the housing having a first rotation stop, and an electrical plug receptacle, mountable within the housing, the insert having a second rotation stop, the first and second rotation stops configured to cooperate with each other to limit rotation of the insert within the aperture at a number of degrees, wherein the plug receptacle is configured to receive an electrical plug.

20 Claims, 4 Drawing Sheets

NXX

REORIENTABLE ELECTRICAL RECEPTACLE

CROSS-REFERENCE TO RELATED APPLICATIONS

This application is a continuation of U.S. application Ser. No. 13/219,865 filed Aug. 29, 2011 and issuing as U.S. Pat. No. 8,210,853 on Jul. 3, 2012, which is a continuation of U.S. application Ser. No. 12/835,722 filed Jul. 13, 2010 and issuing as U.S. Pat. No. 8,007,283 on Aug. 30, 2011, which is a continuation of U.S. application Ser. No. 11/778,948 filed Jul. 17, 2007 and issuing as U.S. Pat. No. 7,753,682 on Jul. 13, 2010.

TECHNICAL FIELD

This disclosure relates to electrical outlets and plugs.

BACKGROUND

Electrical outlets and plugs have been a staple of modern life for many years. Virtually all consumer and business appliances, such as computers, televisions, refrigerators, washers, dryers, and so forth, get their power through electrical outlets. Most modern plugs and outlets employ a three prong design with one prong for live power, one prong for neutral, and one prong for grounding. Similar plugs and outlets have only two prongs omitting the grounding prong. Electrical outlets and prongs are employed to carry many different levels of power, such as 110 volts, 220 volts, and 480 volts.

SUMMARY

There is provided systems and methods for a reorientable electrical outlet. In one embodiment, a system includes a housing configured to be coupled to an electrical power source, the housing having a first rotation stop, and an electrical plug receptacle, mountable within the housing, the insert having a second rotation stop, the first and second rotation stops configured to cooperate with each other to limit rotation of the insert within the aperture at a number of degrees, wherein the plug receptacle is configured to receive an electrical plug.

DETAILED DESCRIPTION

One or more the embodiments set forth below is directed to reorientable electrical outlets. Reorientable electrical differ from traditional, fixed, electrical outlets, by allowing a user to rotate the female receptacle(s). Such rotatable female receptacles may allow plug-in items with unusual shapes (e.g., plug-in transformers, "wall-warts," cell phone chargers, night lights, plug-in room fresheners) to be plugged into a receptacle and then be rotated to prevent the device from blocking access to another receptacle.

Figure 1:
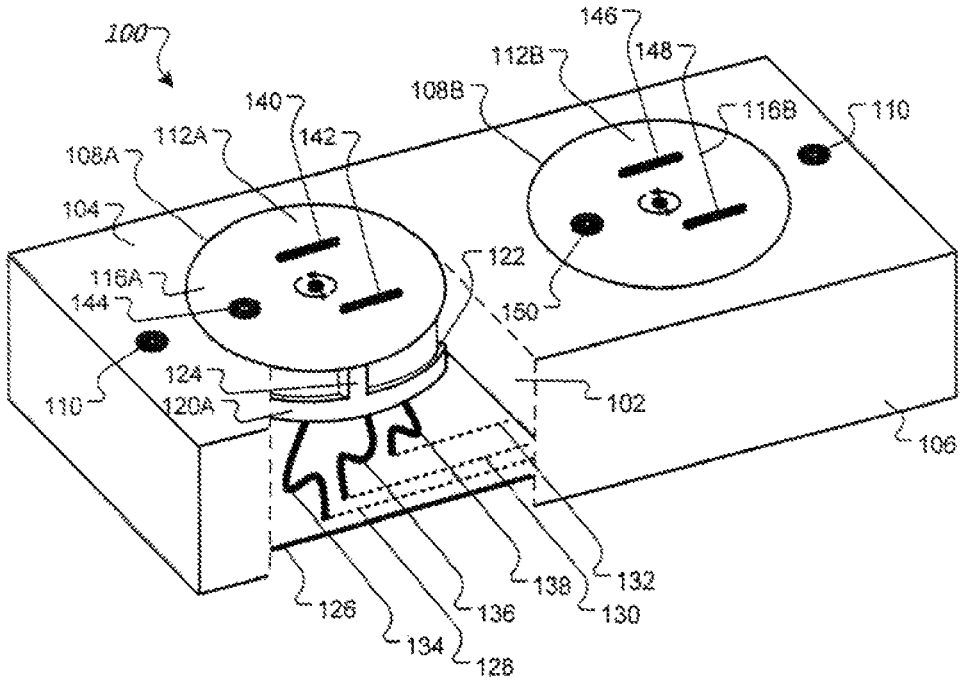
FIG. 1 shows a perspective view of an exemplary reorientable electrical outlet.

FIG. 1 shows a perspective view of an exemplary reorientable electrical outlet 100. The outlet 100 includes a plate 102 having a faceplate portion 104 and a receptacle housing 106. The faceplate 104 and receptacle housing 106 meet to form an enclosed space within the outlet 100. The plate 102 and faceplate 104 include two holes: a hole 108A and a hole 108B. In some embodiments, the dimensions of the outlet 100 may be similar to the dimensions of a traditional electrical outlet. For example, the outlet 100 may be sized as to allow the outlet 100 to be used as a replacement for a traditional electrical outlet. A pair of countersunk screw holes 110 receive screws for mounting the reorientable electrical outlet 100 in a desired surface, such as an electrical box or wall.

In some embodiments, portions of the reorientable electrical outlet 100 may be formed of nonconductive material such as plastic or polyvinyl chloride (PVC). The nonconductive portions may also be formed of nylon or any other suitable supporting material. In some embodiments, portions of the outlet 100 may be manufactured using resins containing high impact amorphous polycarbonate (PC) and acrylonitrile-butadiene-styrene (ABS) terpolymer blends, such as Cycoloy.™.CY6120 from GE Plastics. By varying the ratio of PC to ABS in the resin, the outlet 100 may be tailored for residential or industrial use. Further, the overall cost of the outlet 100 may be reduced by employing regrind or powdering techniques. Preferably, no more than 15% regrind is employed. In some embodiments, portions of the reorientable electrical outlet 100 may be formed of conductive material, such as steel, aluminum, or any other suitable conductive supporting material. For example, the receptacle housing 106, the plate 102, the faceplate 104, and other portions of the outlet 100 may be made of conductive metal, and those portions may be connected to an electrical ground.

The holes 108A and 108B accommodate a stop ring 120A and a stop ring 120B (not shown in FIG. 1). The stop ring 120A is shown in the cutaway of FIG. 1 or in its entirety in FIG. 2. The stop rings 120A-120B include an upper surface 122 and one or more fixed stop tabs, such as fixed stop tab 124, that are located on the upper surface 122. In one embodiment, the stop tab 124 extends vertically or orthogonally from the upper surface 122 of the stop ring 120.

A female electrical receptacle 112A and a female electrical receptacle 112B fit within the respective holes 108A and 108B. The female electrical receptacles 112A and 112B include an outer surface 116A and an outer surface 116B, respectively. In some embodiments, the female electrical receptacles 112A and 112B may extend through the holes 108A and 108B such that the outer surfaces 116A and 116B may be substantially on the same plane as the faceplate 104. In some embodiments, the outer surfaces 116A and 116B may slightly extend beyond the plane of the faceplate 104.

Figure 2:
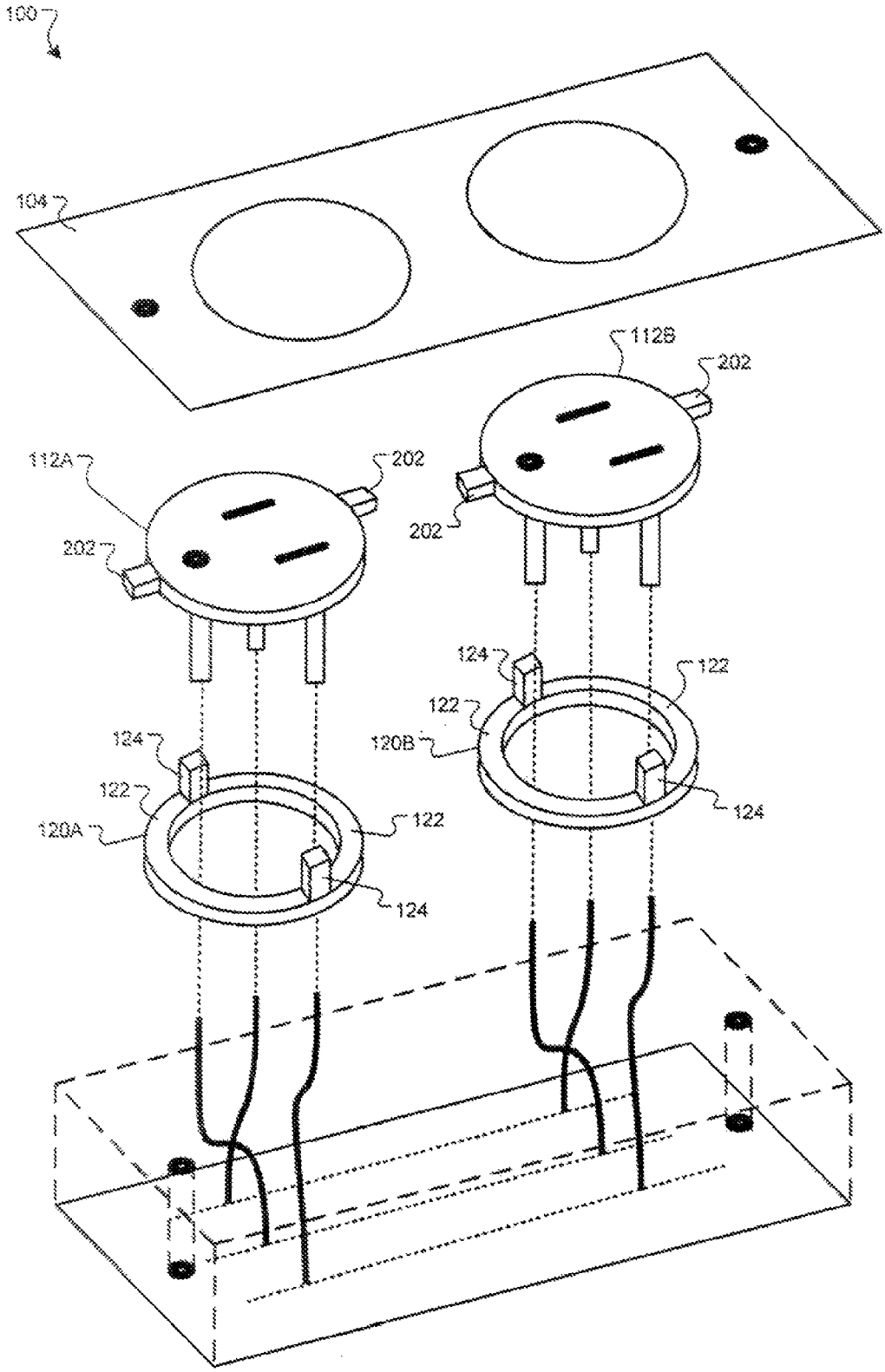
FIG. 2 shows an exploded view of an exemplary reorientable electrical outlet.

Each of the female electrical receptacles 112A and 112B may also include one or more reorientable stop tabs 202 (not shown in FIG. 1, but described in further detail in the description of the illustration of FIG. 2). The female electrical receptacle 112A is placed within the stop ring 120A such that the reorientable stop tab may travel along the upper surface 122 when the female receptacle 112A is reoriented. The amount by which the female electrical receptacle 112A can be reoriented is limited by contact between the reorientable stop tab and the fixed stop tab 124. For example, when a user rotates the female electrical receptacle 112A, the reorientable stop tab travels across the upper surface 122. The reorientable stop tab travels along the stop ring 120A until it contacts the fixed stop tab 124, which limits how far the female electrical receptacle may be rotated within the hole 108.

The outlet 100 also includes a conductor plate 126. The conductor plate 126 includes a number of conductors, such as a conductor 128, a conductor 130, and a conductor 132. The conductor plate 126 is electrically connected to an electrical supply (e.g., wires in an electrical outlet box) such that the electrical conductors 128-132 may be electrically connected to the electrical supply. In some embodiments, the conductor plate 126 may be a printed circuit board (PCB), and the conductors 128-132 may be formed as conductive traces on the conductor plate 126. In some embodiments, the conductors may be PCB traces, bus bars, wires, or other form of electrical conductor.

The electrical conductor 128 is electrically connected to a flexible conductor 134 (e.g., a wire). Similarly, the electrical conductors 130 and 132 are electrically connected to flexible conductors 136 and 138. The flexible conductors 134-138 are coupled between the electrical conductors 128-132 and plug contacts 140-144. In particular, the flexible conductor 134 may connect electrical conductor 128 and the neutral electrical contact 140, the flexible conductor 136 may connect the electrical conductor 130 and the live electrical contact 142, and the flexible conductor 138 may connect between electrical conductor 132 and the ground electrical contact 144. In some embodiments, the flexible conductors 134-138 are wires disposed through the stop ring 120 into the female receptacle 112.

The plug contacts 140-144 are sized and arranged within the female electrical receptacle 112A in a manner that allows an electrical plug to be inserted into them. When the electrical plug is inserted, the plug connects to the plug contacts 140-144. The female electrical receptacle 112B may also include a neutral plug contact 146, a live plug contact 148, and a ground plug contact 150 that are substantially identical to the electrical contacts 140-144. In some embodiments, the outlet 100 may also be made of conductive material that is connected to ground, and the ground electrical contacts 144 and 150 are electrically connected to the outlet 100 itself (e.g., rather than being grounded via the flexible conductor 138).

In an alternate embodiment of the reorientable electrical outlet 100, the female electrical receptacles 112A and 112B may be two prong receptacles. This type of a two-pronged receptacle does not employ the ground electrical components (e.g., the ground electrical contact 150, the flexible conductor 138, because the electrical conductor 132) as the ground plug contact 144 is absent.

FIG. 2 shows an exploded view of the exemplary reorientable electrical outlet 100. In this view, it can be seen that the female electrical receptacles 112A and 112B each include the reorientable stop tabs 202, which were mentioned above. In some embodiments, the female electrical receptacles 112A and 112B are placed such that a bottom portion of the receptacles 112A and 112B extends at least partially through the openings of the stop rings 120A and 120B until the reorientable stop tabs 124 contact the top surfaces 122 of the stop rings 120A and 120B.

The female electrical receptacles 112A and 112B are capable of being rotatably reoriented within the stop rings 122. As the female electrical receptacles 112A and 112B are rotated, the reorientable stop tabs 202 travels circumferentially across the top surfaces 122 until the reorientable stop tabs 202 come into contact with the fixed stop tabs 124. Contact between the reorientable stop tabs 202 and the fixed stop tabs 124 limits the rotation of the female electrical receptacles 112A and 112B.

In the illustrated example, the reorientable female receptacles 112A and 112B are configured such that they may be rotated approximately ¼ turn clockwise or counterclockwise from the depicted initial position. In some embodiments, the fixed stop tabs 124 and the reorientable stop tabs 202 may be configured to limit the rotation of the female receptacles 112A and 112B to any number of degrees, turns, or fractions thereof. For example, a single stop tab 124 and a single reorientable tab 202 may allow for nearly a full total turn. In another example, a reorientable stop tab 202 may be located between two fixed stop tabs 124 that are located at positions 90 degrees apart allowing the female electrical receptacle 112A to be rotated approximately ¼ turn total (e.g., approximately ⅛ turn either way from the illustrated initial position). In some embodiments, the fixed stop tabs 124 and the reorientable stop tabs 202 may be configured to limit the rotation of the female electrical receptacle 112A in an asymmetrical manner. For example, the outlet may be constructed to allow the female electrical receptacle 112A to rotate ½ turn in one direction from an initial position, but only ¼ turn from the initial position in the other direction.

Although illustrated in FIG. 1 as a two-receptacle the reorientable electrical outlet 100 is adaptable to a variety of models and configurations and may be devised to include many other types of electrical receptacles and adapters. For example, the outlet 100 may be embodied in an adapter device to convert a fixed socket to reorientable facility. It should also be understood that, the number, form, and structure of the illustrated female electrical receptacles are merely exemplary. For example, in various embodiments, female electrical receptacles 112A and 112B may be in typical residential receptacles, both grounded and non-grounded, in power strips, in safety outlets (such as GFCI or arc fault outlets), in 220V receptacles, in 480V receptacles, or other receptacles including two, three, four, or more prong designs. These devices allow for prongs of a variety of male plugs to be inserted into the female electrical receptacles and rotated to a desired position within the receptacles' range or rotation. Advantageously, this rotation may enable male plugs to be inserted in non-interfering positions with regard to other male plugs or other types of restrictions.

Figure 3:
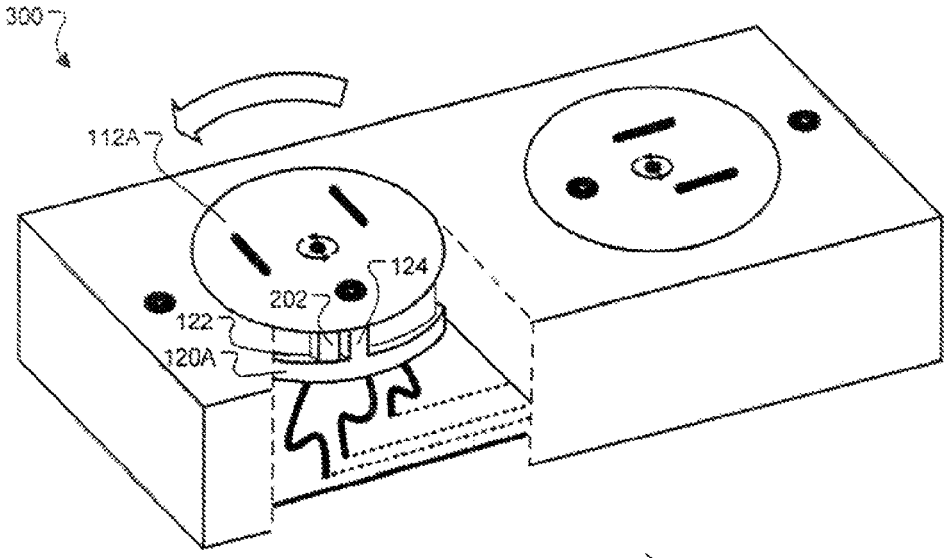
FIG. 3 illustrates the exemplary reorientable electrical outlet of FIG. 1 rotated counterclockwise.

FIG. 3 illustrates the exemplary reorientable electrical outlet 100 of FIG. 1 rotated counterclockwise. The female electrical receptacle 112A has been rotated approximately ¼ turn to the left from the initial position depicted in FIG. 1. As the female electrical receptacle 112A is reoriented, the reorientable stop tab 202 travels circumferentially along the top surface 122 until the reorientable stop tab 202 contacts the fixed stop tab 124. Contact between the reorientable stop tab 202 and the fixed stop tab 124 may limit the counterclockwise rotation of the female electrical receptacle 112A.

Figure 4:
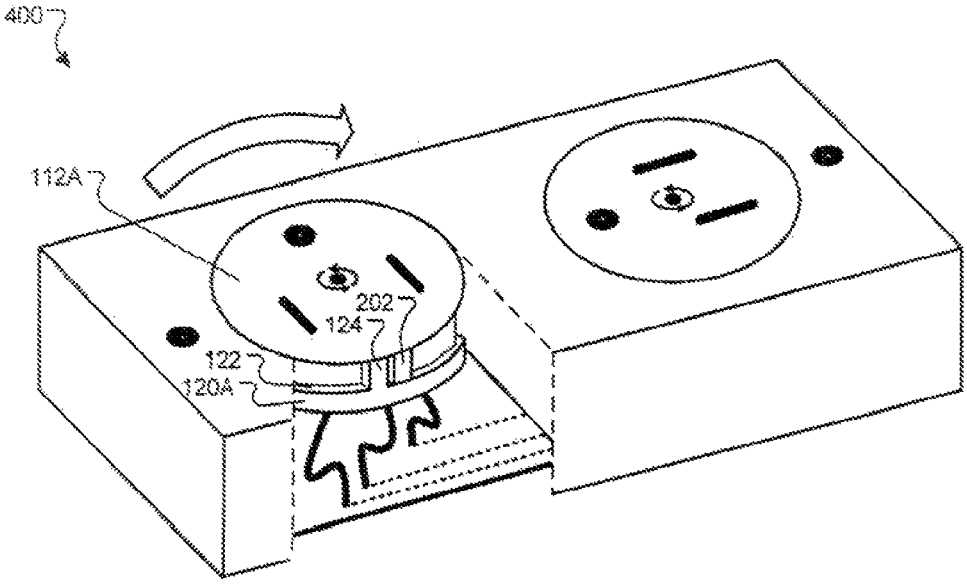
FIG. 4 illustrates the exemplary reorientable electrical outlet of FIG. 1 rotated clockwise.

FIG. 4 illustrates the exemplary reorientable electrical outlet 100 of FIG. 1 rotated clockwise. The female electrical receptacle 112A has been rotated approximately ¼ turn to the right from the initial position depicted in FIG. 1. As the female electrical receptacle 112A is reoriented, the reorientable stop tab 202 travels circumferentially along the top surface 122 until the reorientable stop tab 202 encounters the fixed stop tab 124. Contact between the reorientable stop tab 202 and the fixed stop tab 124 limits the rotation of the clockwise rotation of the female electrical receptacle 112A.

In some embodiments, the limits of the range of motion for the female electrical receptacle 112A may be extended beyond one turn through the use of multiple concentric stop rings. For example, one or more intermediate stop rings may be concentrically disposed between the female electrical receptacle 112A and the stop ring 120A. In this way, up to approximately one full turn may be permitted between the female electrical receptacle 112A and an intermediate stop ring, and up to approximately one full turn may be permitted between the intermediate stop ring and the stop ring 120A, thus allowing up to approximately two total rotations in either direction. In some embodiments, other configurations of stop rings (e.g., the stop ring 120A, or the concentric stop rings), the reorientable stop tabs 202, and/or the fixed stop tabs 124 may be implemented to create various symmetrical and asymmetrical limits of rotation for a female electrical receptacle, such as the receptacle 112A.

Figure 5:
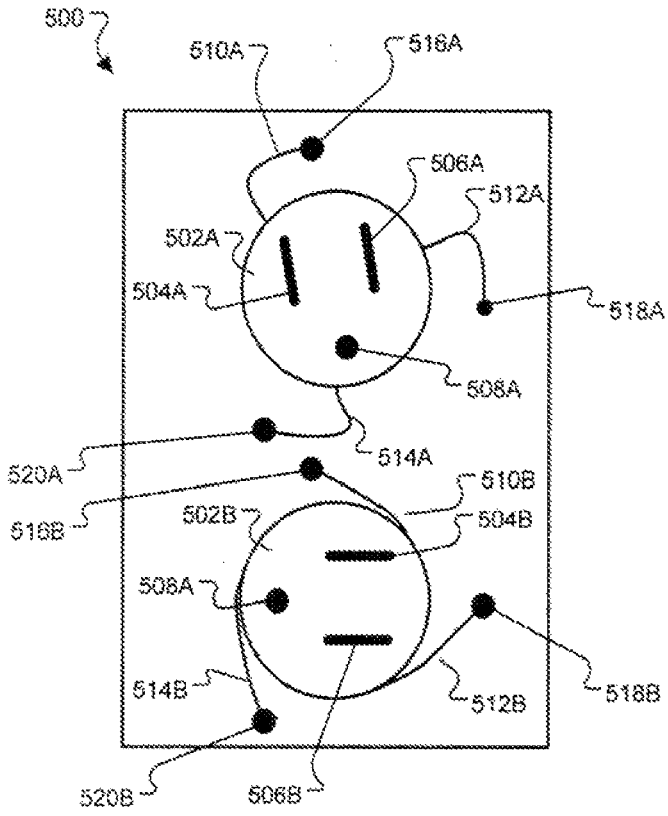
FIG. 5 shows a top view of another embodiment of an exemplary reorientable electrical outlet.

FIG. 5 shows a top view of another type of reorientable electrical outlet, which is labeled with a reference numeral 500. The outlet 500 includes a reorientable female receptacle 502A and a reorientable female receptacle 502B. The reorientable female receptacle 502A includes a neutral electrical contact 504A, a live electrical contact 506A, and a ground electrical contact 508A. The neutral electrical contact 504A is connected to a flexible conductor 510A. The live electrical contact 506A is connected to a flexible conductor 512A. The ground electrical contact 508A is connected to a flexible conductor 514A.

The reorientable female receptacle 502B includes a neutral electrical contact 504B, a live electrical contact 506B, and a ground electrical contact 508B. The neutral electrical contact 504B is connected to a flexible conductor 510B. The live electrical contact 506B is connected to a flexible conductor 512B. The ground electrical contact 508B is connected to a flexible conductor 514B. In some embodiments, the flexible conductors 510A-514A and 510B-514B are wires.

The outlet 500 also includes a neutral post 516A, a neutral post 516B, a live post 518A, a live post 518B, a ground post 520A, and a ground post 520B. The neutral posts 516A and 516B are electrically connected to the neutral leg of an electrical supply. The live posts 518A and 518B are electrically connected to the live leg of an electrical supply. The ground posts 520A and 520B are electrically connected to an electrical ground. The neutral posts 516A and 516B are electrically connected to the neutral electrical contacts 504A and 504B by the flexible conductors 510A and 510B, respectively. The live posts 518A and 518B are electrically connected to the live electrical contacts 506A and 506B by the flexible conductors 512A and 512B, respectively. The ground posts 520A and 520B are electrically connected to the ground electrical contacts 508A and 508B by the flexible conductors 514A and 514B, respectively.

As the reorientable female receptacles 502 are rotated within the outlet 500, the conductors 510-514 are progressively drawn tauter around the body of the receptacle 502. Eventually, the conductors 510-514 may reach their limit of extension and rotation of the receptacle 502 stop. For example, the female electrical receptacle 502A has been rotated counterclockwise approximately ⅛ turn; and, as shown, the conductors 510A-514A are relatively lax. On the other hand, the female electrical receptacle 502B has been rotated clockwise approximately ¼ turn extending the conductors 510B-514B to their limit of extension. The degrees of rotation in the clockwise direction may be different than the number of degrees rotation in the counter-clockwise direction.

Figure 6:
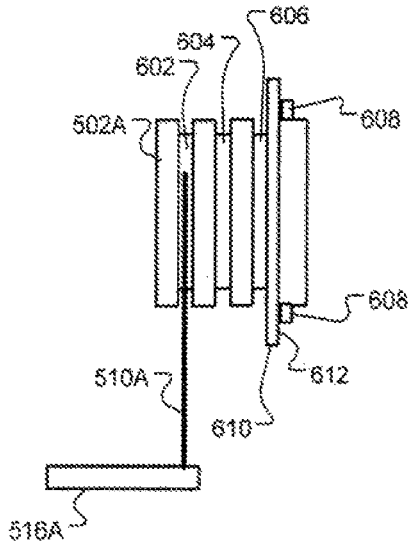
FIG. 6 shows a side view of the exemplary reorientable female receptacle of FIG. 5.

FIG. 6 is a side view of the exemplary reorientable female receptacle 502A. As shown, the reorientable female receptacle 502A may include an annular groove 602, an annular groove 604, and an annular groove 606. The grooves 602-606 may hold the conductors 510-514 and may provide locations where electrical contact may be made between the flexible conductors 510A-514A and the electrical contacts 504A-508A. For example, the flexible conductors 510-514 can be connected to contacts within the annular grooves 602-606. For example, one end of the flexible conductor 510A is connected to a contact within the annular groove 602 while the other end of the conductor 510A is connected to the electrical post 516A. Similarly, the flexible conductors 512A and 514A may attach to points on the electrical posts 518A and 520A respectively (not shown). As such, when the receptacle 502A is reoriented, the flexible conductors 510A-514A are drawn taut and captured within the annular grooves 516-520.

In the illustrated embodiment, the female receptacle 502A also includes a pair of reorientable stop tabs 608 and a stop ring 610. As the receptacle 502A is reoriented, the reorientable stop tabs may travel across the outer surface 612 of the stop ring 610. The receptacle can rotate until one the reorientable stop tabs 608 encounters a fixed stop tab (not shown) that is attached to the stop ring. The reorientable stop tabs 608 and the fixed stop tabs may be configured to limit the reorientation of the receptacle 502A, as described above, to prevent over extension of conductors 510-514. In other embodiments, the stop tabs 608 and the stop ring 610 may be omitted. For example, the flexible conductors 510-514 may be employed to limit rotation of the female receptacles 502. In other words, the rotation of the receptacle 502 may stop when one or more of the conductors become fully extended and stops rotation of the receptacle 502.

Although the depicted embodiments of the reorientable electrical outlet 100 and the reorientable electrical outlet 500 include two grounded female electrical receptacles, the outlets 100 and 500 are usable for a variety of female electrical receptacles including those that employ a single receptacle, or more than two receptacles. It should also be recognized that the female electrical receptacles 112A, 112B, 502A, and 502B may be replaced or supplemented by any type of similar female socket that allows proper insertion and contact with a mating male-type conduct of prongs of a male plug. Moreover, outlets 100 and 500 are not limited to use with 110V-220V AC-type or DC-type appliances.

In some embodiments, the concepts of the reorientable electrical outlet 100 are applied to male electrical plugs. For example, a wall transformer may include a reorientable male plug that may allow the transformer to be rotated while plugged into a traditional, fixed outlet. In some embodiments, several reorientable electrical outlets may be arranged into a power strip configuration. In another embodiment, several reorientable electrical outlets are arranged as an outlet expander. For example, three, four, five, six, or other number of reorientable electrical outlets could be arranged in a device that plugs into a single outlet or a traditional two-receptacle wall outlet. In another embodiment, the reorientable electrical outlets 100 and 500 may be located at one or both ends of a power cord. For example, an extension cord may have one or more reorientable electrical outlets (or male plugs) at one or both ends, to allow odd-sized devices to be plugged in, or perhaps to reduce tangling.

Although the embodiments here and have been described in detail, it will be apparent to those skilled in the art that many embodiments taking a variety of specific forms and reflecting changes, substitutions, and alterations can be made without departing from the spirit and scope of the invention. The described embodiments illustrate the scope of the claims but do not restrict the scope of the claims.

What is claimed is:

1. An electrical outlet comprising:

a housing comprising a female electrical socket having a first surface with passages to receive conductive prongs of a male electrical plug and an axis of rotation extending through the first surface;

a faceplate comprising an opening adapted and configured receive the first surface of the socket and permit rotation of the first surface of the socket within the opening about the axis of rotation;

a stop ring disposed in the housing and comprising a first stop and a second stop;

a third stop aligned to contact the first stop at a first limit of rotation of the socket and to contact the second stop at a second limit of rotation of the socket, with rotation of the socket limited to a range between the first limit and the second limit; and electrical pathways connecting the socket to an external power source.

2. The electrical outlet of claim 1 in which the electrical pathways comprise flexible conductors.

3. The electrical outlet of claim 2 in which a flexible conductor comprises a wire.

4. The electrical outlet of claim 2 further comprising one or more channels configured to receive the flexible electrical conductors.

5. The electrical outlet of claim 1 in which the electrical pathways connect the socket to an external power source for only a portion of the range of rotation of the socket.

6. The electrical outlet of claim 1 in which the electrical pathways connect the socket to an external power source throughout the range of rotation of the socket.

7. The electrical outlet of claim 1 in which one of the stops protrudes in a direction parallel to the axis of rotation.

8. The electrical outlet of claim 1 in which the third stop is arcuately moveable in a plane generally perpendicular to the axis of rotation.

9. The electrical outlet of claim 1 in which the third stop is arcuately moveable in a plane generally parallel to the stop ring.

10. The electrical outlet of claim 1 in which the third stop protrudes into a gap along the stop ring between the first stop and the second stop.

11. An electrical outlet comprising:

a female electrical socket having a first surface with passages to receive conductive prongs of a male electrical plug and an axis of rotation extending through the first surface;

a faceplate comprising an opening adapted and configured receive the first surface of the socket and permit rotation of the first surface of the socket within the opening about the axis of rotation;

a stop ring disposed around the socket and comprising a first stop and a second stop;

a third stop aligned to contact the first stop at a first limit of rotation of the socket and to contact the second stop at a second limit of rotation of the socket, with rotation of the socket limited to a range between the first limit and the second limit;

a fourth stop aligned to contact the second stop at the first limit of rotation of the socket and to contact the first stop at the second limit of rotation of the socket; and flexible electrical conductors configured to maintain a power connection between the socket and an external power source.

12. The electrical outlet of claim 11, wherein the stop ring extends in a plane that is generally parallel to a plane of the face.

13. The electrical outlet of claim 12, in a portion of the third stop and a portion of the fourth stop lie in the plane, with the portion of the third stop on an opposite side of the axis of rotation from the portion of the fourth stop.

14. The electrical outlet of claim 11, in which the flexible electrical conductors comprise electrical wire.

15. The electrical outlet of claim 11, in which the flexible electrical conductors maintain the power connection throughout the limit of rotation.

16. An electrical outlet comprising:

a female electrical socket having a first surface with passages to receive conductive prongs of a male electrical plug and an axis of rotation extending through the first surface;

a faceplate comprising an opening adapted and configured receive the first surface of the socket and permit rotation of the first surface of the socket within the opening about the axis of rotation;

a stop ring disposed below the faceplate around the socket and comprising a first stop, a second stop, and a gap extending between the first stop and the second stop;

a third stop extending into the gap and oriented to contact the first stop at a first limit of rotation of the socket and to contact the second stop at a second limit of rotation of the socket, with rotation of the socket limited to a range between the first limit and the second limit; and flexible electrical conductors connecting the socket to an external power source.

17. The electrical outlet of claim 16, in which at least one of the stops comprises a tab extending radially away from the socket.

18. The electrical outlet of claim 16, in which one of the stops protrudes in a direction parallel to the axis of rotation.

19. The electrical outlet of claim 16, in which the third stop is arcuately moveable in a plane generally perpendicular to the axis of rotation.

20. The electrical outlet of claim 16, in which the third stop is arcuately moveable in a plane generally parallel to the stop ring.

* * * * *